US010231550B2

(12) United States Patent
Weirun

(10) Patent No.: US 10,231,550 B2
(45) Date of Patent: Mar. 19, 2019

(54) COLLAPSIBLE CUP OR CELL PHONE HOLDER FOR CHAIR ARM

(71) Applicant: Shanghai Jirun Industrial Co., Ltd., Qingpu, Shanghai (CN)

(72) Inventor: Zhang Weirun, Shanghai (CN)

(73) Assignee: Shanghai Jirun Industrial Co., Ltd., Shanghai (CN)

( * ) Notice: Subject to any disclaimer, the term of this patent is extended or adjusted under 35 U.S.C. 154(b) by 375 days.

(21) Appl. No.: 15/277,582

(22) Filed: Sep. 27, 2016

(65) Prior Publication Data

US 2018/0084917 A1 Mar. 29, 2018

(51) Int. Cl.

| | |
|---|---|
| ***A47C 7/62*** | (2006.01) |
| ***A47C 7/54*** | (2006.01) |
| ***A47C 4/20*** | (2006.01) |
| ***A47C 7/68*** | (2006.01) |

(52) U.S. Cl.

CPC ..... *A47C 7/624* (2018.08); *A47C 4/20* (2013.01); *A47C 7/54* (2013.01); *A47C 7/62* (2013.01); *A47C 7/68* (2013.01)

(58) Field of Classification Search

CPC .. A47C 7/62; A47C 7/624; A47C 7/54; B60N 3/102

USPC ..... 297/188.15, 188.16; 248/311.2, 312.1; 220/8

See application file for complete search history.

(56) References Cited

U.S. PATENT DOCUMENTS

2013/0264339 A1* 10/2013 Oldani ..... B60N 3/102 220/8
2014/0319883 A1* 10/2014 Shively ..... A47C 4/28 297/35

FOREIGN PATENT DOCUMENTS

CN 201948442 U * 8/2011

* cited by examiner

*Primary Examiner* — Milton Nelson, Jr.
(74) *Attorney, Agent, or Firm* — Robert C. Kain, Jr.

(57) ABSTRACT

Collapsible holder for folding chair is set in a chair arm and the 3-D chair arm plane. The holder holds a cup or a cell phone (shape dependent, round or rectangular). The holder has a moveable member and a stationary member. The moveable member has a bottom plate, two or more upstanding legs and the legs have tabs. The stationary member has an upper lip, side wall(s) and retainers for the legs. The legs slidably move in the stationary member retainers such that in a collapsed mode, the bottom plate is closest to the lip and the holder is encased in the 3-D chair arm plane and, in the expanded mode when the tab acts as a stop against the retainer and the bottom plate is farthest away from the top surface of the chair arm and the lip, thereby enabled to hold a cup or cell phone.

6 Claims, 9 Drawing Sheets

COLLAPSIBLE CUP OR CELL PHONE HOLDER FOR CHAIR ARM

This is a regular patent application.

The present invention relates to collapsible cup or cell phone holders for folding chairs.

BACKGROUND OF THE INVENTION

Cup holders are convenient to hold and secure beverage containers. Cup holders are sometimes built into the arms of outdoor or folding chairs. Some cup holders are simply attachable to a folding chair either by attachment to the frame of the chair or to the chair arm. Cup holders may be used to hold a variety of other objects for a user of a chair, including a beverage, cup, cell phone, change, wallet, keys, etc. Some holders may be round to fit a beverage or cup and some holders may be shaped to fit other items, such as a phone. To properly secure a beverage container or other item, the cup holder must have sufficient depth to adequately hold and secure the item. A cup holder with an adequate depth hangs or protrudes below the chair arm and interferes with the ability of the chair to completely fold. A folding chair that completely folds is desired by the end user for ease of storage and transport of the chair. A folding chair that completely folds is also desirable by the manufacturer and supplier for ease of shipping the chairs and the ability to ship the maximum number of chairs per shipment.

Some cup holders or storage modules for folding chairs are flexible in that they are made of netting, beverage cooler foam, or any material sufficiently flexible to be folded. Such a storage module is adapted to fit in and hang from a chair arm when the chair is unfolded for sitting. These flexible cup holders and storage modules fail to provide the strong support for the item being stored. The flexible cup holders and storage modules also interfere with the ability of the chair to completely fold.

SUMMARY OF THE INVENTION

A need exists for a collapsible cup holder and collapsible cell phone holder for chairs, or other objects, which meet a significant number of the desirable design characteristics and also provide improved holding of the beverage or other item and which does not interfere with the ability of the chair to fold completely. In some embodiments, the present collapsible cup holder and cell phone holder provides the improved ability to secure a beverage or other article while also allowing a flat configuration upon folding and relatively inexpensive and easy manufacture and/or assembly. The cup holder will be circular in shape. The cell phone holder will be rectangular in shape so that it can hold a cell phone, electronic device or other items. In the preferred embodiment, the chair will contain both a cup holder and a cell phone holder, one in each arm of the chair.

In general, the collapsible holder sits in a 3-D chair arm plane of a folding chair. The holder holds a cup or a cell phone (shape dependent, round or rectangular) and has a moveable member and a stationary member. The moveable member has a bottom plate, two or more upstanding legs and the legs have tabs. The stationary member has an upper lip, side wall(s) and retainers for the legs. The legs slidably move in the stationary member retainers such that in a collapsed mode, the bottom plate is closest to the lip and the holder is encased in the 3-D chair arm plane and, in the expanded mode when the tab acts as a stop against the retainer and the bottom plate is farthest away from the top surface of the chair arm and the lip, thereby enabled to hold a cup or cell phone.

A collapsible holder for a folding chair which is set within a chair arm, comprising a moveable member that includes a bottom flat plate, at least two upstanding legs, and a tab on the forward end of the upstanding legs. The stationary member includes an upper lip, a side wall and at least two retainers. The upstanding legs slidably engage the stationary member, the upstanding legs being inserted through the retainer and the upstanding legs being held in the retainer by the tab. The collapsible holder is set into a void in a chair arm wherein the chair arm consist of a substantially flat top surface, a substantially flat bottom surface, and a substantially perpendicular side surface, all defining a 3-dimensional (3-D) shape of the arm. The upper lip of the collapsible holder lays on top of the substantially flat top surface of the arm chair and prevents the collapsible holder from falling through the void of the chair arm. The folding chair may include a holder on each chair arm.

A collapsible cup holder for a folding chair comprising a void in a folding chair arm for receiving a collapsible cup holder, the chair arm having a substantially flat top surface, a substantially flat bottom surface, and a substantially perpendicular side surface, all defining a 3-dimensional shape of the chair arm. The collapsible cup holder comprises two pieces, a moveable member and a stationary member. The moveable member has a bottom flat plate, at least two upstanding legs, and two tabs on the forward end of each upstanding leg. The stationary member has an upper lip, a side wall and at least two retainers. The upstanding legs slidably engage the stationary member, the upstanding legs being inserted through the retainer and the upstanding legs being held in the retainer by the tabs. The upper lip of the collapsible cup holder lays on top of the substantially flat top surface of the arm chair and prevents the collapsible cup holder from falling through the void of the chair arm. The moveable member is able to be slidably pushed upwards into the stationary member and the folding chair is able to be folded in a flat configuration without any interference from the cup holder. The moveable member is able to be slidably extended downward from the stationary member to fully deploy the collapsible cup holder.

A collapsible cell phone holder for a folding chair comprising a void in a folding chair arm for receiving a collapsible cell phone holder, the chair arm having a substantially flat top surface, a substantially flat bottom surface, and a substantially perpendicular side surface, all defining a 3-dimensional shape of the chair arm. The collapsible cell phone holder comprises two pieces, a moveable member and a stationary member. The moveable member has a bottom flat plate, at least two upstanding legs, and two tabs on the forward end of each upstanding leg. The stationary member has an upper lip, a side wall and at least two retainers. The upstanding legs slidably engage the stationary member, the upstanding legs being inserted through the retainer and the upstanding legs being held in the retainer by the tabs. The upper lip of the collapsible cell phone holder lays on top of the substantially flat top surface of the arm chair and prevents the collapsible cup holder from falling through the void of the chair arm. The moveable member is able to be slidably pushed upwards into the stationary member and the folding chair is able to be completely folded without any interference from the cell phone holder. The moveable member is able to be slidably extended downward from the stationary member to fully deploy the collapsible cell phone holder.

BRIEF DESCRIPTION OF THE DRAWINGS

These and other features, objects, aspects and advantages of the present chair adjustment mechanism are described herein with reference to drawings of preferred embodiments, which are provided for the purpose of illustration and not for limitation.

DETAILED DESCRIPTION OF THE EMBODIMENTS

The present invention is related to a collapsible cup or cell phone holder for chairs. For a cup holder, the two-piece containment structure is generally round. For a cell phone holder, the two-piece containment structure is rectangular. Operationally, they are substantially similar but their shapes are different.

The collapsible holders are disclosed herein in the context of a folding chair, which chair can be unfolded and positioned on a surface. See FIGS. 1A and 1B. The chair can also be folded into a generally flat configuration. See FIG. 2. The collapsible holders and the corresponding folding chair are often described herein using relative terms, such as forward, rearward, above, below, upper, lower, left and right. These terms are used for convenience and usually in the context of the specific figure(s) being described, unless otherwise noted or apparent from the context.

Figure 1A:
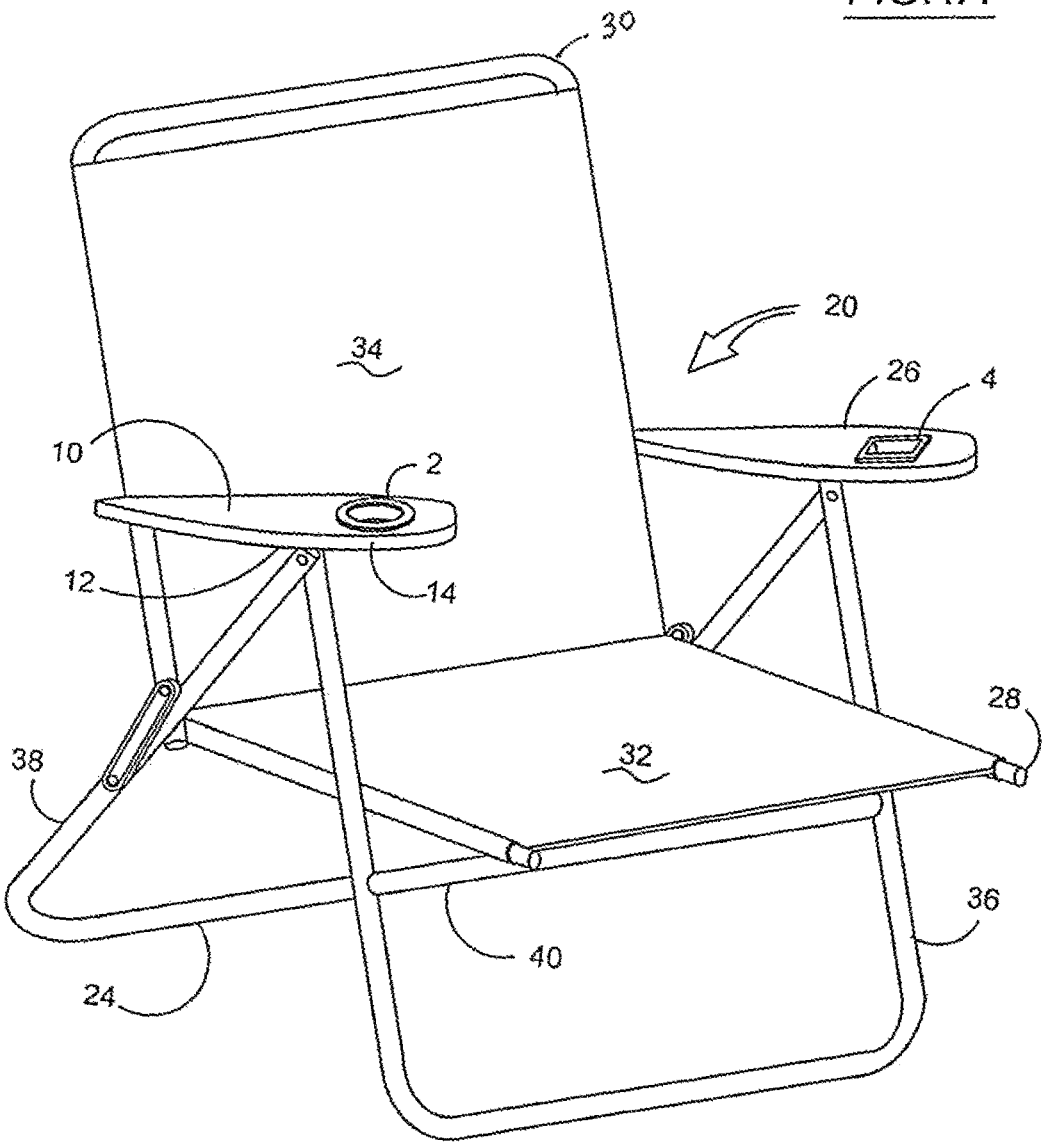
FIG. 1A is a perspective view of a folding chair including holders in a collapsed position.
Figure 1B:
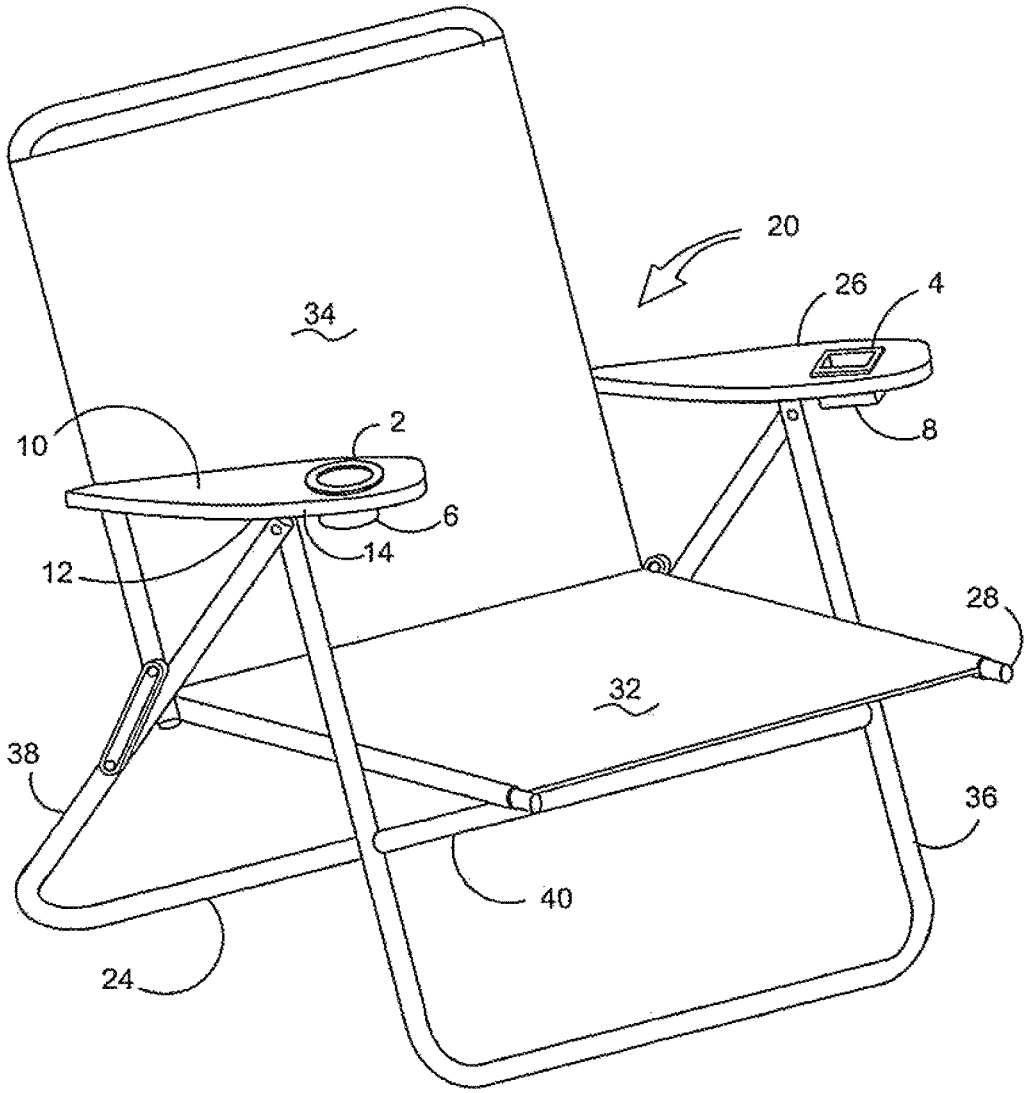
FIG. 1B is a perspective view of a folding chair with holders in an extended position.

FIGS. 1A and 1B illustrates a folding chair 20 that includes two collapsible holders 2, 4. In this embodiment, one chair arm 26 contains a circular shaped cup holder 2 and the other chair arm contains a rectangular shaped holder or cell phone holder 4. The illustrated chair 20 includes a frame 24 and a pair of armrests or arms 26 supported by or relative to the frame 24 and extending in a fore-aft direction on each side of the chair 20. The frame 24 can include a seat frame portion 28 and a backrest or back frame portion 30. The seat frame portion 28 can support or define a seat portion 32 of the chair 20 and the back frame portion 30 can support or define a backrest 34 of the chair 20. The seat frame portion 28, seat portion 32, back frame portion 30 and backrest 34 can be of any suitable construction. For example, each one or a combination of several of these components can be constructed of a unitary piece of material. In other arrangements, the frame portions 28, 30 can be of a rigid material (e.g., metal or plastic, rod or tubular) construction and the seat 32 and backrest 34 can be constructed of a fabric (or other suitable material) panel or plurality of panels or strips that extend between or are supported by the frame portions 28, 30.

The frame 24 preferably also includes at least one front leg portion 36 and at least one rear leg portion 38. The front leg portion 36 and rear leg portion 38 can be of any suitable construction. For example, one or both of the front leg portion 36 and rear leg portion 38 can include multiple legs. That is, the chair 20 can include two (or more) front legs and two (or more) rear legs, which may or may not be coupled to one another. However, in the illustrated arrangement, the front leg portion 36 includes a generally U-shaped frame portion, and can include one or more cross supports 40. Similarly, the illustrated rear leg portion 38 includes a generally U-shaped frame portion, and can include optional cross supports (not shown). The front leg portion 36 and rear leg portion 38 support the seat frame portion 28, seat portion 32, back frame portion 30 and backrest 34.

In addition, the front leg portion 36 and the rear leg portion 38 preferably are pivotally coupled to one another at or near their upper ends (free ends of the U-shaped frame portions). Accordingly, the front leg portion 36 and the rear leg portion 38 can fold relative to one another. Preferably, the front leg portion 36 and the rear leg portion 38 can fold one inside the other such that the frame portions are positioned side-by-side in a lateral direction, thereby minimizing the thickness of the folded leg portions 36, 38 in the folded configuration. In the illustrated arrangement, the front leg portion 36 has a smaller lateral dimension than the rear leg portion 38 so that the front leg portion 36 is positioned within the rear leg portion 38. However, this orientation could also be reversed. Furthermore, preferably the seat portion 32 and backrest 34 are pivotally connected and can fold relative to one another so that the entire chair 20 can fold in a manner well known to those in the art.

As shown in FIGS. 1A and 1B, the arms 26 consist of a substantially flat top surface 10, a substantially flat bottom surface 12, and a substantially perpendicular side surface 14, all defining a 3-dimensional shape (herein "3-D") of the arms 26. Sometimes, this spatial structure is described as the 3-D chair arm plane since the flat top and bottom surfaces and the chair arm sidewalls form a 3-D solid plane, except for the hole for the cup/sell phone holder. FIG. 1A is a perspective view of a folding chair 20 and shows the holders 2, 4 in a collapsed position. FIG. 1B is a perspective view of a folding chair 20 and shows the holders 2, 4 in an extended position. The cup holder 2 or cell phone holder 4 are set within the arms 26 and the expandable portion 6, 8 of the cup holder 2 and cell phone holder 4 extend beyond the 3-D shape of the arms 26 and protrude outward from the substantially flat bottom surface 12 of the arms 26.

Figure 2:
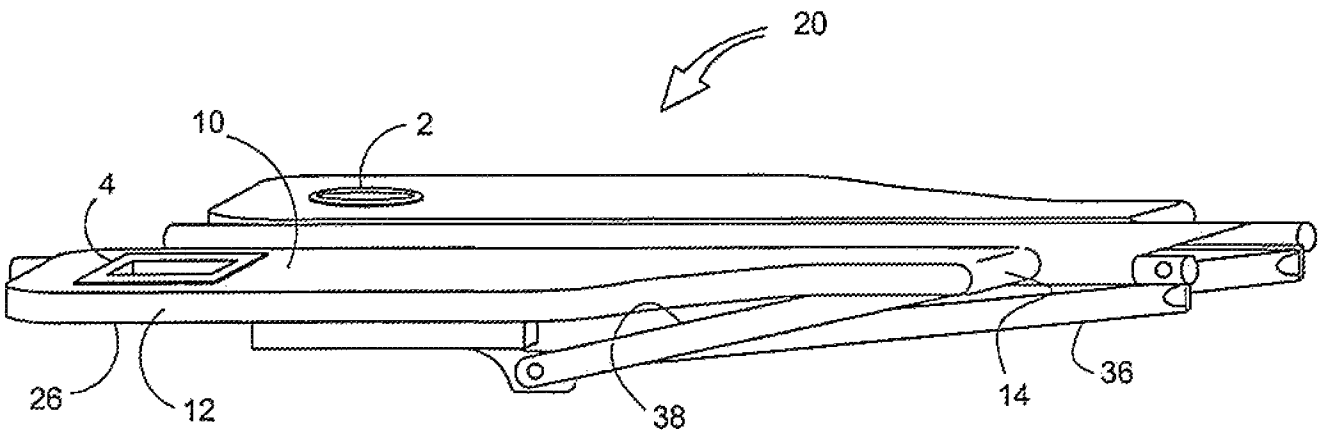
FIG. 2 diagrammatically illustrates a folding chair in the folded position.

FIG. 2 shows chair 20 in a fully collapsed position. Chair arm 26 is shown with the cup holder 2 and the cell phone holder 4 in collapsed positions so that they do not interfere with the folding of the chair. In the collapsed position, the cup/cell phone holder is substantially completely encased in the 3-D chair arm plane. Stated otherwise, the collapsed holder is inserted within the 3-D chair arm plane. It is substantially completely contained with the 3-D plane. Chair legs 36, 38 have been collapsed substantially parallel to the chair arm 26 and the cup holder 2 and the cell phone holder 4 in no way impede the complete folding of the chair. In the collapsed position, cup holder 2 and cell phone holder 4 are no thicker in height than the substantially perpendicular side surface 14 of the chair arm 26. Because cup holder 2 and cell phone holder 4 are completely within the 3-D structure of the chair arm 26, they do not interfere with the complete folding of the folding chair 20. More importantly, since the holder does not interfere with the complete closure of the arms and legs, these chairs can be stacked more compactly for shipping bundles of chairs from the manufacturer overseas to the U.S. distributor. More compact shipping containment of 20, 30 or 50 chairs reduces the shipping cost of each chair.

FIG. 1B shows the holder in a fully expanded position enabling a cup or cell phone to be retained in the holder. FIG. 1A shows the holders in a fully closed or collapsed position. These collapsed holders are substantially encased in the 3-D chair arm plane in FIG. 1A.

Figure 3:
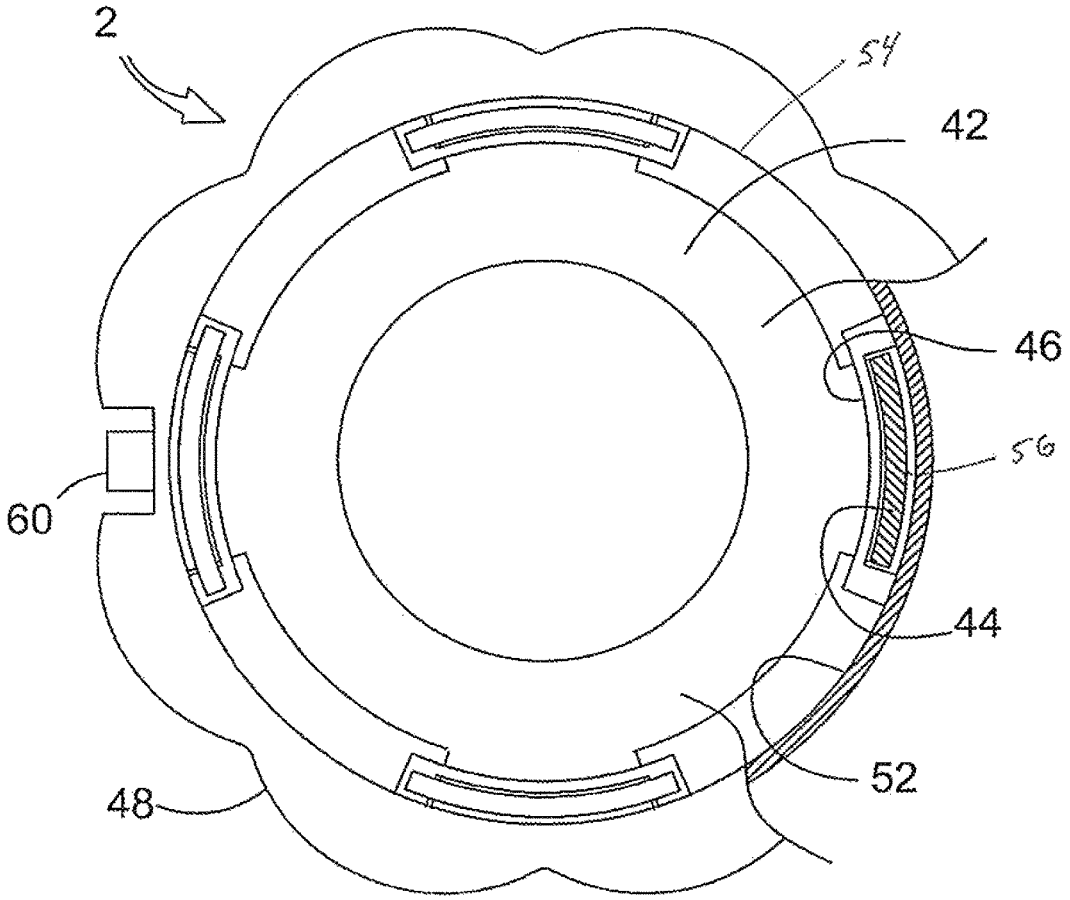
FIG. 3 is a top view of the cup holder.

FIG. 3 is a top view of the cup holder 2. The cup holder 2 is composed two pieces, one is moveable member 56 and one is stationary member 54. The moveable member 56 includes the bottom floor plate 42 and upstanding legs 44. The stationary member 54 includes the side walls 52, an upper lip 48, and a retainer 46. The moveable member 56 is seated within the stationary member 54. The upstanding legs 44 are attached to the bottom floor plate 42 of the moveable member 56. The upstanding legs 44 are received and captured by the retainer 46 which form slots through which the upstanding legs 44 are fed. The fitting of the upstanding legs 44 into the retainer 46 allows the moveable member 56 to be extended in a downward direction to expand the depth of the cup holder 2 or to be retracted and collapsed. The moveable member 56 and stationary member 54 are designed to be permanently coupled together with the upstanding legs 44 secured in the retainer 46.

The upper lip 48 of the stationary member 54 is mounted on the top surface 10 of the chair arm 26. The upper lip 48 is generally perpendicular to the cylindrical side wall 52 of the stationary member 54. The upper lip 48 prevents the cup holder 2 from falling through the hole into which it is fixed in the chair arm 26. The cup holder 2 is also preferably fixedly attached to the arm chair 26 by glue, bonding, screws or other known attachment means.

Figure 4:
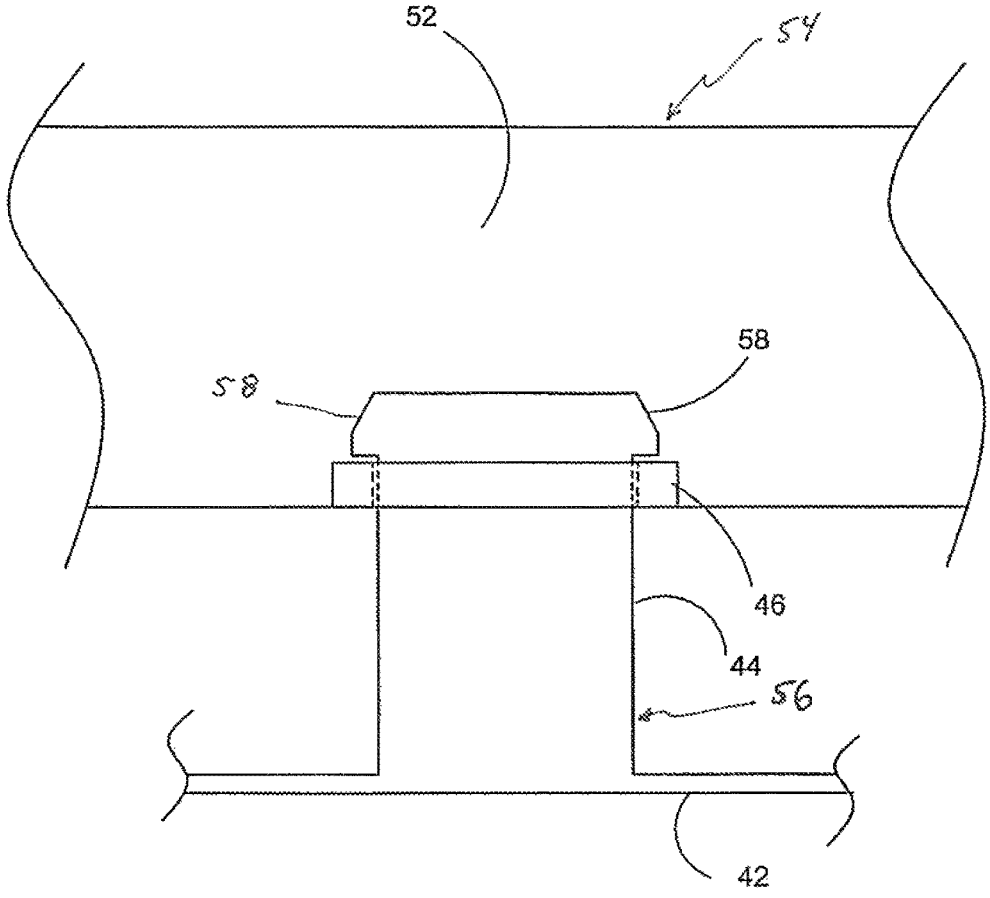
FIG. 4 is a partial view, from inboard looking out, of an upstanding leg with the cup holder in an extended position.

FIG. 4 is a partial view of the cup holder 2, from inboard looking out, of an upstanding leg 44 with the cup holder 2 in an extended position. As further shown in FIG. 5 by broken lines, when the moveable member 56 is extended in the downward direction away from the stationary member 54, the cup holder 2 is in a fully extended, useable position. This is fully expanded position. The depth of the cup holder 2 is at its maximum. Returning to FIG. 4, shown is the tab 58 on the forward end of the upstanding leg 44. The tab 58 extends beyond the retainer 46 to stop the upstanding leg 44 from being extended any further beyond the tab 58. The tab 58 also serves to secure the circular bottom floor plate 42 to the stationary member 54 when fully extended. The tab 58 ensures that the upstanding leg 44 is not removed from the retainer 46 of the stationary member 54. The tab 58 keeps upstanding leg 44 slidably permanently connected to the stationary member 54.

Figure 5:
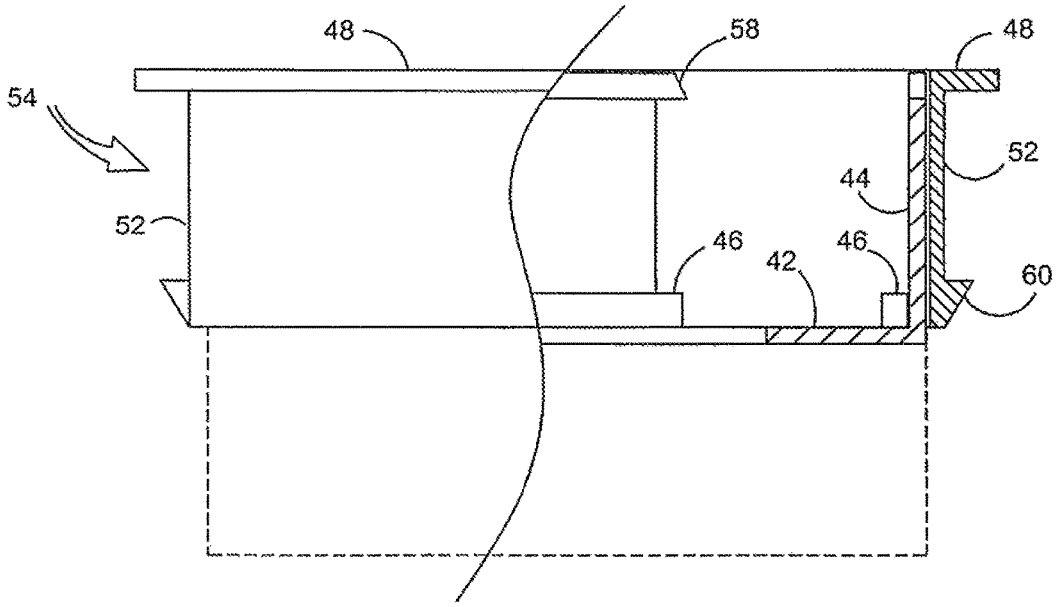
FIG. 5 is a side view of a cup holder, partially broken away, in a collapsed position, with broken lines showing the extended position.
Figure 6:
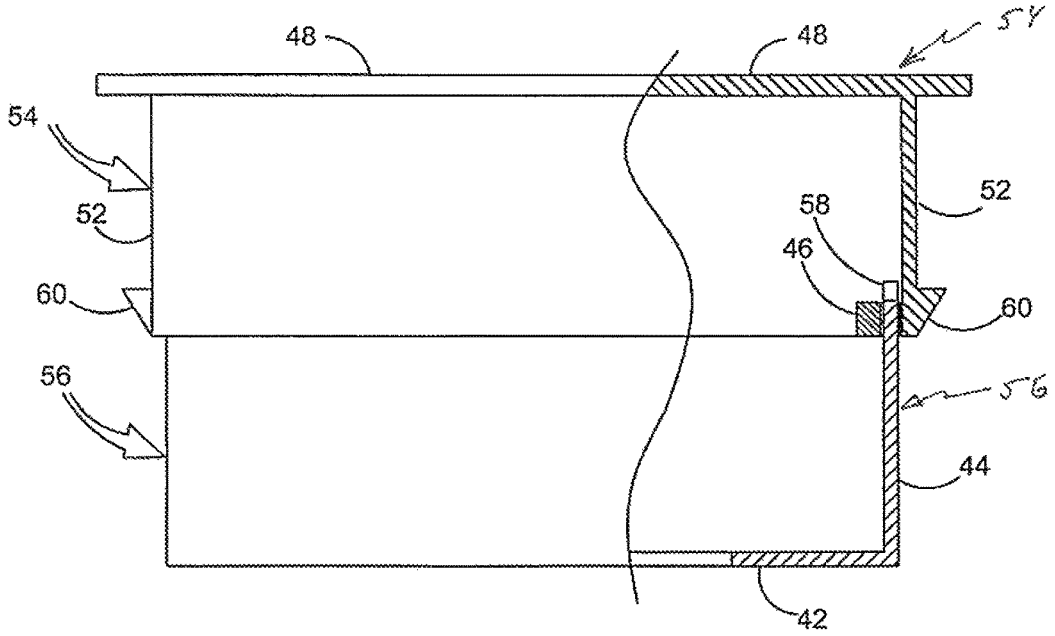
FIG. 6 is a side view of a cup holder, partially broken away, in an extended position.

FIG. 5 is a side view of a cup holder 2, partially broken away, in a collapsed position, with broken lines showing the extended position of the cup holder 2. In the collapsed position, the moveable member 56 lies almost completely within the stationary member 54. FIG. 6 is a side view of a cup holder 2, partially broken away, in an extended position. The moveable member 56 is slidably engaged with the stationary member 54, which allows the cup holder 2 to collapse and expand. In FIG. 6, the moveable member 56 is shown fully extended from within the stationary member 54. The slidably engaging fit of the stationary member 54 and the moveable member 56 is such that the upstanding legs 44 and the side wall 52 create an interference fit. This prevents the moveable member 56 from being extended without being pulled downward by the user. The friction fit causes the holder 2, 4 to remain in a collapsed position until the user extends the holder 2, 4.

As shown in FIG. 5, the outboard portion of the stationary member 54 has a upper lip 48, a side wall 52, and a lock element 60. The lock element 60 locks the cup holder 2 within the chair arm 26 by a tension fit with the thickness of the chair arm 26 between the upper lip 48 and the lock element 60. The lock element 60 is optional. The cup holder 2 could be fit within the chair arm 26 by an interference fit without the use of a lock element 60 or otherwise secured to the chair arm 26 by known means. Shown in the partially broken away view is the upper lip 48, the side wall 52, the upstanding leg 44, the lock element 60, the retainer 46, and the bottom flat plate 42. The partially broken away view permits view of the moveable member 56 collapsed within the stationary member 54. In the collapsed position, the upstanding leg 44 is adjacent the side wall 52. In the fully collapsed position, as shown in FIG. 5, the moveable member 56 fits entirely within the stationary member 54. This allows for the folding chair 20 to completely close without interference from the cup holder 2 protruding from the bottom surface 12 of the chair arm 26.

FIG. 6 is a side view of a cup holder 2, partially broken away, in an extended position. The moveable member 56 is slidably engaged with the stationary member 54, such that the moveable member 56 is fully deployed or extended. In this position, the cup holder 2 is at its maximum depth and would function to hold a beverage or other article. The stationary member 54 is held within the 3-D dimensional plane of the chair arm 26, or the substantially perpendicular side surface 14, by the locking member 60 and upper lip 48.

As shown in FIG. 6, the outboard portion of the stationary member 54 has a upper lip 48, a side wall 52, and a lock element 60. Shown in the partially broken away view is the upper lip 48, the side wall 52, the lock element 60, and the retainer 46. The partially broken away view permits view of the moveable member 56 extended out of the stationary member 54. In the extended position, the moveable member 56 is fully deployed or extended from the stationary member 54. The upstanding legs 44 and the circular bottom flat plate 42 of the moveable member 56 are extended below the stationary member 54.

The extension of the holders 2, 4 is effectuated by a user manually pulling the moveable member 56 in a downward direction to fully extend the holder 2, 4. In order to extend the holder 2, 4, the user will grip the bottom circular flat plate 42 and pull downward. A hole or void in the center of the circular bottom flat plate 42 can also be used to grip the circular bottom flat plate 42 when pulling it downward. Optionally, the holders 2, 4 may be extended by the user pushing the bottom flat plate 42 in a downward direction until the holder 2, 4 is fully extended. This may be the easiest method of extending the holders 2, 4 when the folding chair 20 is in an unfolded position and the user is sitting in the seat or standing next to the seat. From this vantage point, the user will simply put their fingers into the holder 2,4 and push the bottom flat plate 42 in a downward direction to fully extend the holder 2, 4. Optionally, the user may use the object to be put in the holder 2, 4, to push or extend the bottom flat plate 42 into an extended position.

To collapse the holder 2, 4, the user will push the bottom flat plate 42 upwards toward the stationary member 54. This will cause the upstanding legs 44 to slidably engage the retainer 46 until the moveable member 56 is collapsed completely within the stationary member 54. The holders 2, 4 are preferably collapsed prior to the folding chair 20 being folded up. Collapsing the holders 2, 4 allow the chair to be compactly and completely folded. In the collapsed position, the bottom plate is closest to the upper lip or the top surface of the chair arm.

Figure 7:
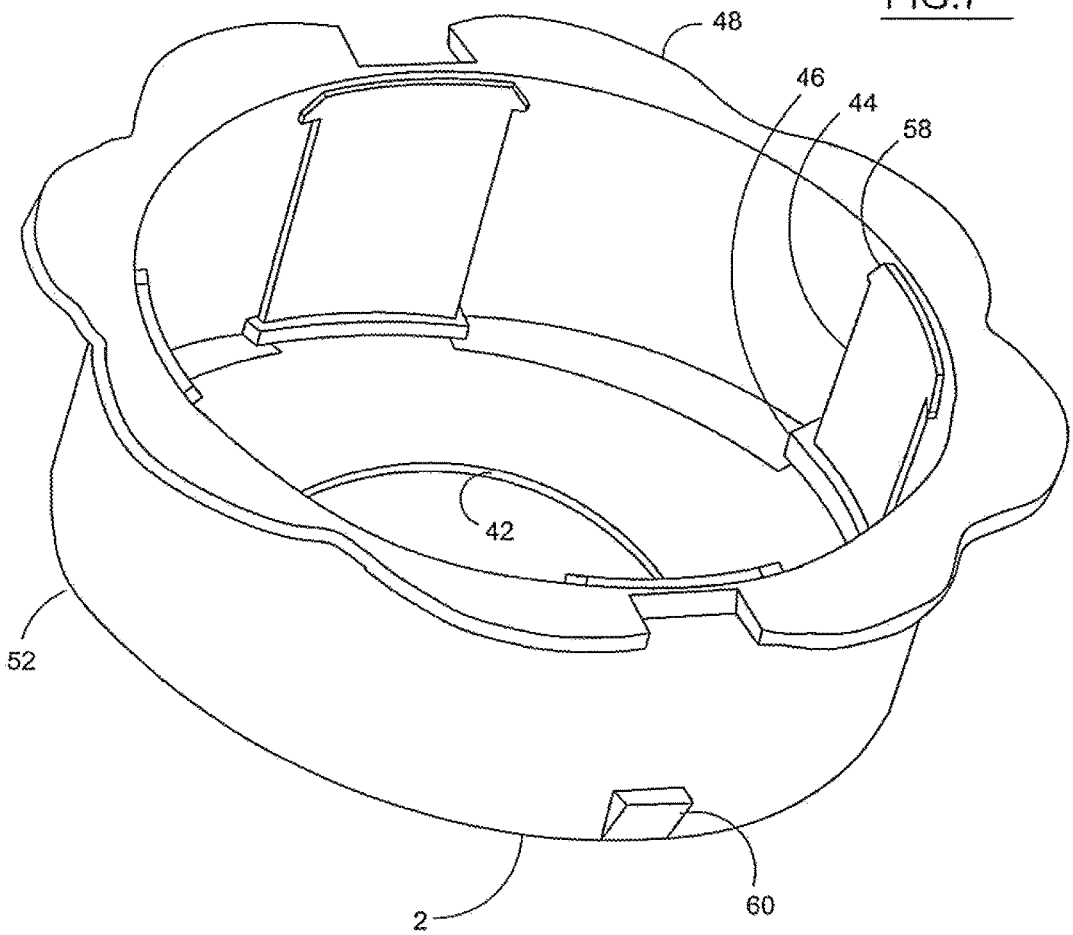
FIG. 7 is a perspective view of a cup holder.

FIG. 7 is a perspective view of a cup holder. Shown are the bottom floor plate 42, upstanding legs 44, tab 58, the side walls 52, an upper lip 48, and a retainer 46. The cup holder 2 is in the collapsed position. The moveable member 56 is seated within the stationary member 54. The upstanding legs 44 are attached to the bottom floor 42 of the moveable member 56. The upstanding legs 44 are received and captured by the retainer 46 which form slots through which the upstanding legs 44 are fed. The fitting of the upstanding legs 44 into the retainer 46 allows the moveable member 56 to be extended in a downward direction to expand the depth of the cup holder 2 or to be retracted and collapsed. The tab 58 at the forward end of the upstanding legs 44 serves as a stop to prevent the upstanding legs 44 from being removed from the retainer 46 or from being extended beyond the fully extended position. The moveable member 56 and stationary member 54 are designed to be permanently coupled together with the upstanding legs 44 secured in the retainer 46 by tab 58.

The upper lip 48 of the stationary member 54 is mounted on the top surface 10 of the chair arm 26. The upper lip 48 is generally perpendicular to the cylindrical side wall 52 of the stationary member 54. The upper lip 48 prevents the cup holder 2 from falling through the hole into which it is fixed in the chair arm 26. The cup holder 2 is also preferably fixedly attached to the arm chair 26 by glue, bonding, screws or other known attachment means. The lock element 60 locks the cup holder 2 within the chair arm 26 by a tension fit with the thickness of the chair arm 26 between the upper lip 48 and the lock element 60.

Figure 8:
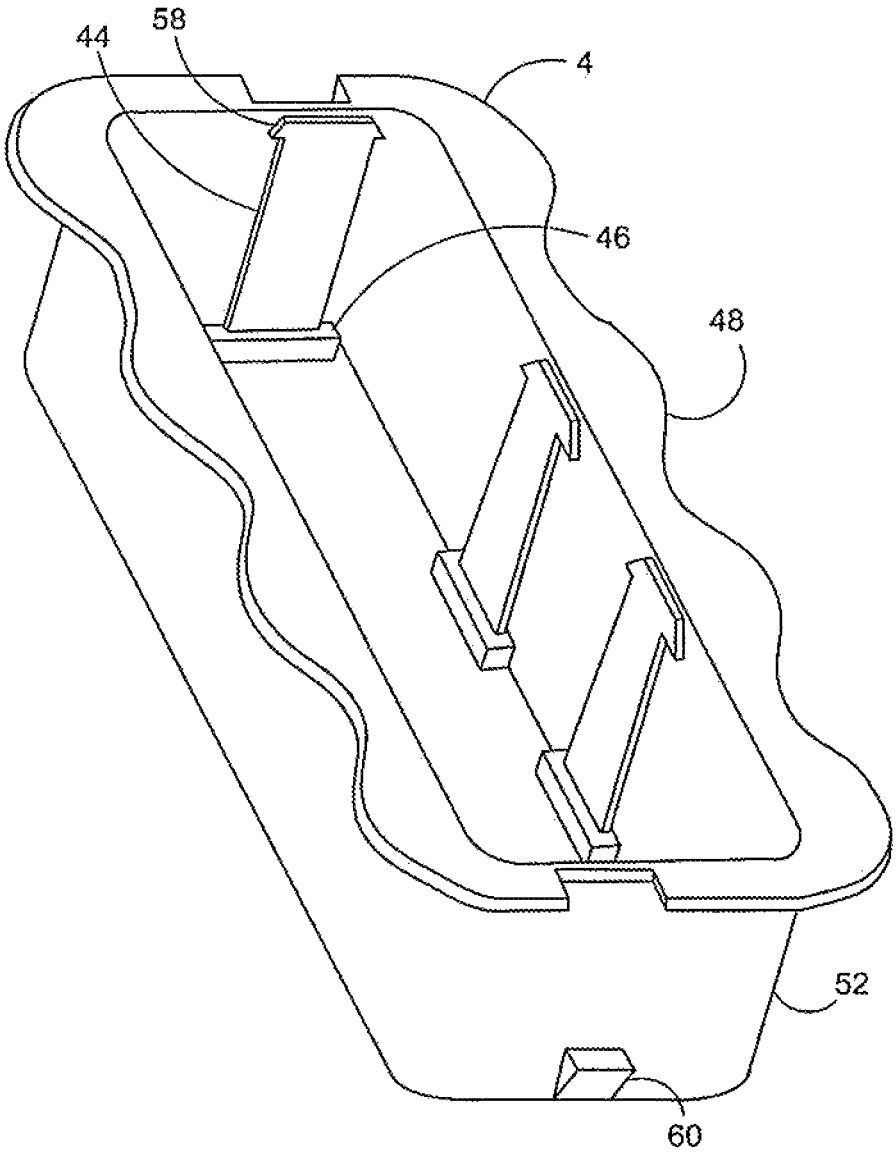
FIG. 8 is a perspective view of a cell phone holder.

FIG. 8 is a perspective view of a cell phone holder 4. The same components as used in the cup holder 2 are used in the cell phone holder 4, the significant difference being that the cell phone holder 4 is rectangular in shape. Obviously, the cell phone holder 4 can hold a variety of items, other than or including a cell phone. Shown are the bottom floor plate 42, upstanding legs 44, tab 58, the side walls 52, an upper lip 48, and a retainer 46. The cell phone holder 2 is in the collapsed position. The cell phone holder 4 will preferably have a cut out section of the bottom floor plate 42 through which cords from a cell phone could pass.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof, in particular, while the present collapsible holder has been described in the context of particularly preferred embodiments, the skilled artisan will appreciate, in view of the present disclosure, that certain advantages, features and aspects of the adjustment mechanism may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

The invention claimed is:

1. A collapsible cup holder for a folding chair comprising:

a void in a folding chair arm for receiving a collapsible cup holder, the chair arm having a substantially flat top surface, a substantially flat bottom surface, and a substantially perpendicular side surface, all defining a 3-dimensional shape of the chair arm;

the collapsible cup holder comprising two pieces, a moveable member and a stationary member;

the moveable member has a bottom flat plate, at least two upstanding legs, and two tabs on a forward end of each upstanding leg;

the stationary member has an upper lip, a side wall and at least two retainers;

the upstanding legs slidably engage the stationary member, the upstanding legs being inserted through the retainer and the upstanding legs being held in the retainer by the tabs;

the upper lip of the collapsible cup holder lays on top of the substantially flat top surface of the arm chair and prevents the collapsible cup holder from falling through the void of the chair arm;

wherein the moveable member is able to be slidably pushed upwards into the stationary member and the folding chair is able to be folded in a flat configuration without any interference from the cup holder; and wherein the moveable member is able to be slidably extended downward from the stationary member to fully deploy the collapsible cup holder.

2. The collapsible cup holder of claim 1, wherein the cup holder is circular.

3. The collapsible cup holder of claim 1, wherein the cup holder has four upstanding legs and four retainers.

4. A collapsible cell phone holder for a folding chair comprising:

a void in a folding chair arm for receiving a collapsible cell phone holder, the chair arm having a substantially flat top surface, a substantially flat bottom surface, and a substantially perpendicular side surface, all defining a 3-dimensional shape of the chair arm;

the collapsible cell phone holder comprising two pieces, a moveable member and a stationary member;

the moveable member has a bottom flat plate, at least two upstanding legs, and two tabs on the forward end of each upstanding leg;

the stationary member has an upper lip, a side wall and at least two retainers;

the upstanding legs slidably engage the stationary member, the upstanding legs being inserted through the retainer and the upstanding legs being held in the retainer by the tabs;

the upper lip of the collapsible cell phone holder lays on top of the substantially flat top surface of the arm chair and prevents the collapsible cup holder from falling through the void of the chair arm;

wherein the moveable member is able to be slidably pushed upwards into the stationary member and the folding chair is able to be folded in a flat configuration without any interference from the cell phone holder; and wherein the moveable member is able to be slidably extended downward from the stationary member to fully deploy the collapsible cell phone holder.

5. The collapsible cell phone holder of claim 4, wherein the cell phone holder is rectangular.

6. The collapsible cell phone holder of claim 4, wherein the cell phone holder has six upstanding legs and six retainers.

* * * * *